US006538185B1

(12) United States Patent
Stratton

(10) Patent No.: US 6,538,185 B1
(45) Date of Patent: Mar. 25, 2003

(54) PEDAL BOARD ASSEMBLY

(75) Inventor: Michael K. Stratton, Topeka, KS (US)

(73) Assignee: MKS Professional Stage Products, Inc., Topeka, KS (US)

( * ) Notice: Subject to any disclaimer, the term of this patent is extended or adjusted under 35 U.S.C. 154(b) by 0 days.

(21) Appl. No.: 09/975,887

(22) Filed: Oct. 10, 2001

(51) Int. Cl.[7] ..... G10D 13/02
(52) U.S. Cl. ..... 84/422.1; 84/426; 84/444
(58) Field of Search ..... 84/422.1, 225, 84/426, 444

(56) References Cited

U.S. PATENT DOCUMENTS 3,913,443 A 10/1975 Jewett ..... 84/1.28
4,151,774 A * 5/1979 Klann ..... 84/426
4,488,468 A 12/1984 Peterson et al. ..... 84/1.01
5,786,540 A * 7/1998 Westlund ..... 84/645
5,866,829 A 2/1999 Pecoraro ..... 84/177

* cited by examiner

*Primary Examiner*—Kim Lockett
(74) *Attorney, Agent, or Firm*—Wm Bruce Day

(57) ABSTRACT

A pedal board assembly for receiving a plurality of musical sound effect generators generally comprises a box-like receptacle with a removable lid. The receptacle contains a top tier of flat, fixed pitch panels including a power supply and an audio circuit interface. A middle tier is of a fixed, tilted pitch and a lower tier is of selectively flat or tilted pitch mode, the tilted pitch mode matching the pitch of the middle tier so that large sound effect generators may be placed across to span both the middle tier and the lower tier.

5 Claims, 2 Drawing Sheets

PEDAL BOARD ASSEMBLY

FIELD OF THE INVENTION

This invention relates to equipment for generating musical sound effects and particularly to holders for such devices.

BACKGROUND OF THE INVENTION

Musical sound effect generators are quite popular with instrumental groups and are used in conjunction with the playing of instruments, typically electric guitars, to create desired sound effects with the music. The sound effect generators are of the rack mount type or may be the foot pedal type, which are operated by foot movement of the instrument player. The sound effect generators are used in conjunction with the instrument and an amplifier such that the instrument is connected to the amplifier for amplifying the sounds generated by the instrument and for play through a speaker. The sound effect generators are connected to the amplifier so that the sound effects are mixed with the music generated by the musical instrument. The sound effect generators are typically placed on the floor near where the musician is playing. There are often several such foot pedal operated sound effect generators in use and which may be scattered about the stage floor during a performance and interconnected by wiring to the amplifier so that there tend to be numerous wires and cables on stage. These can become entangled, the musician may trip over them and set up and take down time is employed to bring order to the assembly. Pedal boards, such as disclosed in U.S. Pat. No. 6,215,055 are sometimes used and are helpful in resolving the disorder caused by multiple foot pedals, rack mounts and runs of cables. The goal is to keep the various sound effect generators as neat and orderly as possible and to reduce or keep orderly the webbing of cables of wires that criss-cross the stage. In conjunction with keeping the sound effects generators orderly and contained during performance, it is also desirable to provide a handy container for transporting the sound effect generators and retaining them in an orderly manner. To this end, applicant has invented a unique pedal board designed to overcome the above described difficulties and intended to resolve deficiencies as seen in the prior art.

OBJECTS OF THE INVENTION

The objects of the present invention are:

a) to provide a pedal board for receiving a plurality of foot operated musical sound effect generators;

b) to provide such a pedal board which comprises a box like receptacle with a removable lid for orderly transport of the sound effect generators;

c) to provide such a pedal board which includes a plurality of tiers for placing the sound effect generators on in such a manner that they can be readily accessed by the foot of a musician;

d) to provide such a pedal board which includes a power supply and audio circuit interface controls to make more orderly the amount of wires and cables which would otherwise be necessary to connect the sound effect generators to amplifiers;

e) to provide such a pedal board which has variable height tiers for placing the pedals thereon so as to accommodate pedals of various size and including matching the tilt of adjacent tiers so that an elongate or larger than normal size foot pedal can be placed across adjacent tiers; and f) to provide such a pedal board which is inexpensive to construct and particularly designed for the intended purpose.

Other objects and advantages of the present invention will become apparent from the following description taken in connection with the drawings.

SUMMARY OF THE INVENTION

A pedal board assembly for receiving a plurality of musical sound effect generators comprises a box-like receptacle with a removable lid. The receptacle includes a generally level top tier including a power supply and audio circuit interface, a titled middle tier, and a lower tier which can be arranged in a level mode or a tilted mode, the tilted mode matching the pitch of the middle tier so that large sound effect generators may be placed across to span both the middle tier and the lower tier.

DESCRIPTION OF THE PREFERRED AND ALTERNATE EMBODIMENTS

As required, detailed description of the preferred and alternate embodiments are disclosed herein, other embodiments or configurations may be apparent and within the concept of the invention and may be based upon the follow description to those having ordinary skill in the art.

Figure 1:
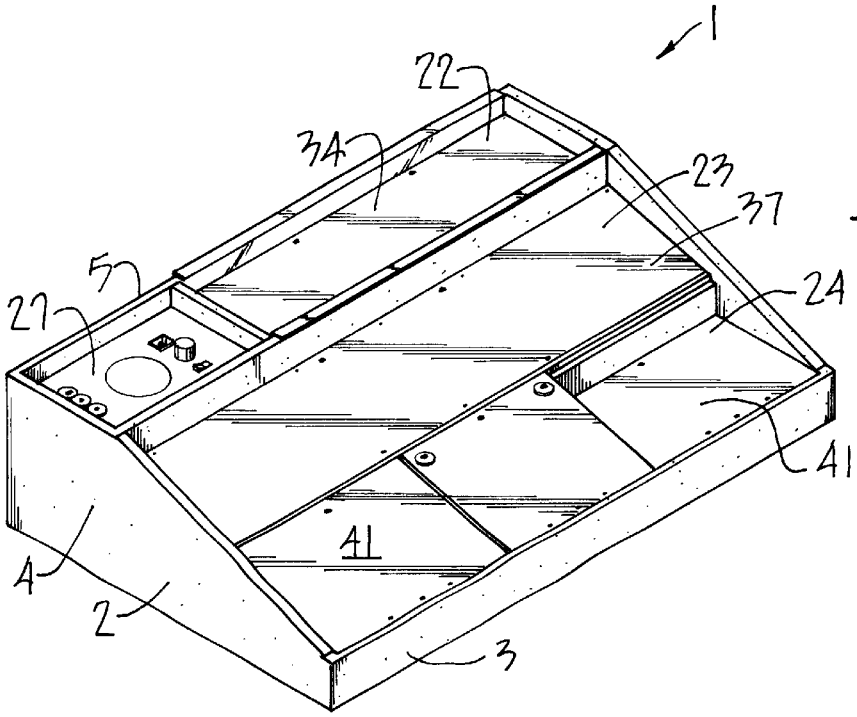
FIG. 1 is a perspective view of a pedal board embodying the present invention.
Figure 2:
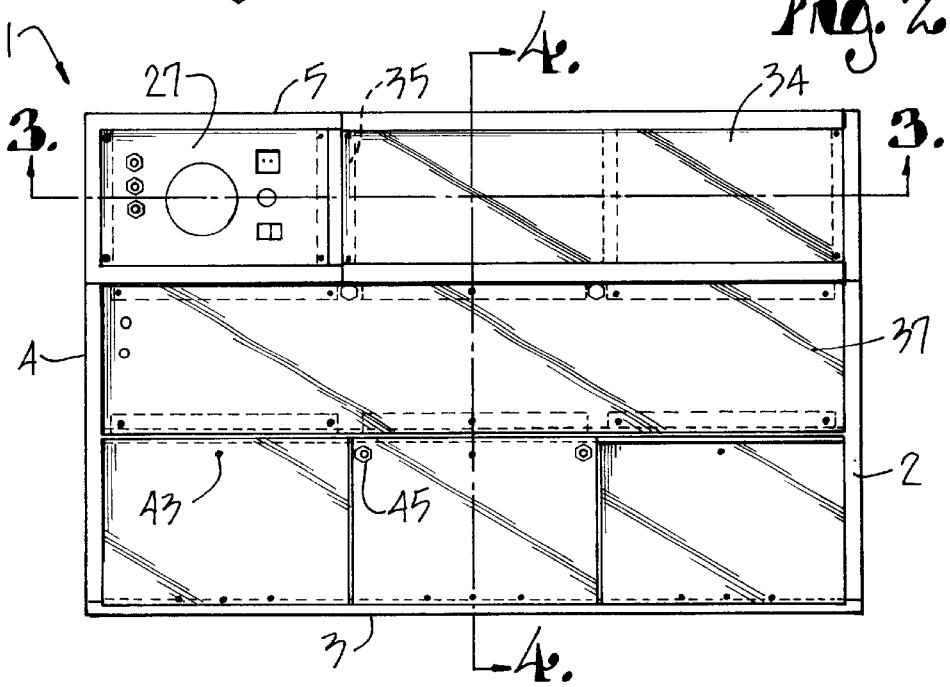
FIG. 2 is a plan view of the pedal board shown in FIG. 1.
Figure 3:
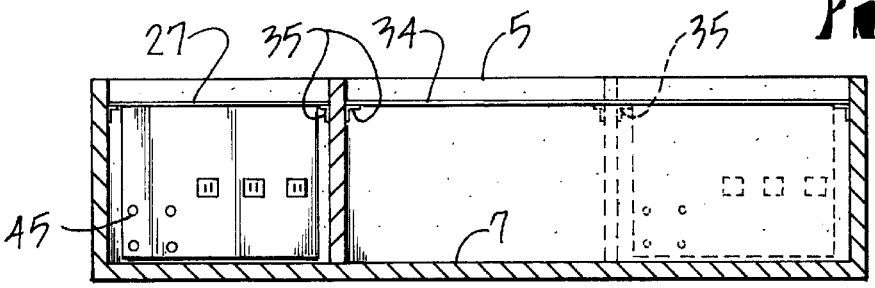
FIG. 3 is a longitudinal sectional view taken along lines 3—3, FIG. 2.

The reference 1, FIG. 1 generally indicates a pedal board assembly embodying the present invention. The pedal board assembly board 1 is generally formed of a lower box-like receptacle 2 including a low front wall 3, side walls 4 and a high back wall 5. A bottom wall 7 covers the base. The assembly may include a removable cover 8 which is shaped to provide the lower receptacle 2 with a generally rectangular box structure shape when the cover 8 is in place. The cover 8 includes a top wall 8, short back wall 10, high front wall 11 and opposite side walls 12. Hinge parts 14 are of the separable type and extend between the cover 8 and the bottom receptacle 2. Latch parts 15 extend between the cover 8 and the bottom receptacle 2 on the respective front walls 3 and 11 and close the two parts when connected.

Preferably, the receptacle 2 and cover 8 are formed of a vinyl fabric covered wood or plastic or may alternatively be of lightweight metal such as aluminum. The receptacle 2 is divided into three tiers by a first interior wall 17 and a second interior wall 18. The pedal board assembly 1 permits sound effect generators, such as rack mount devices or foot pedals, to be wired into it and thus be a semi-permanent storage and use case. To accommodate internal wiring, wiring passages 20 extend through the bottoms of the first and second interior walls 17 and 18. The internal longitudinal interior walls 17 and 18 divide the receptacle into a top tier 22, middle tier 23 and bottom tier 24. The top tier 22 includes a power supply and audio circuit connector box 27 having a fuse carrier or reset button 28, on/off switch 29, power supply plug in receptacle 30 and a plurality of special effects out put jack receptacles 32. The electrical box 27 is situated in the top tier 22 in such a manner that it be either positioned at the top left comer or the top right corner and may be moved therein as desired by the user, The remainder of the top tier 22 is filled by an elongate panel 34. Removable cross supports 35 support the panel 34. Generally, the electrical box fills one third of the length of the top tier 22 and the panel 34, two thirds. An exemplary measurement of the top tier 22 is 7 inches deep by 28.75 inches long. The top tier 22 is preferably level or flat, without tilt or pitch, and in the illustrated example, is fixed in a flat relation to hold special effects pedals flat.

The middle tier 23 is formed by an elongate middle panel 37 and is mounted to be a slight tilt or pitch, such as 16 degrees. The middle panel 37 is maintained in position by supports 38 and is affixed thereto by screws 39. An exemplary measurement of the middle tier 23 is 5½ inches by 28.75 inches.

Figure 4:
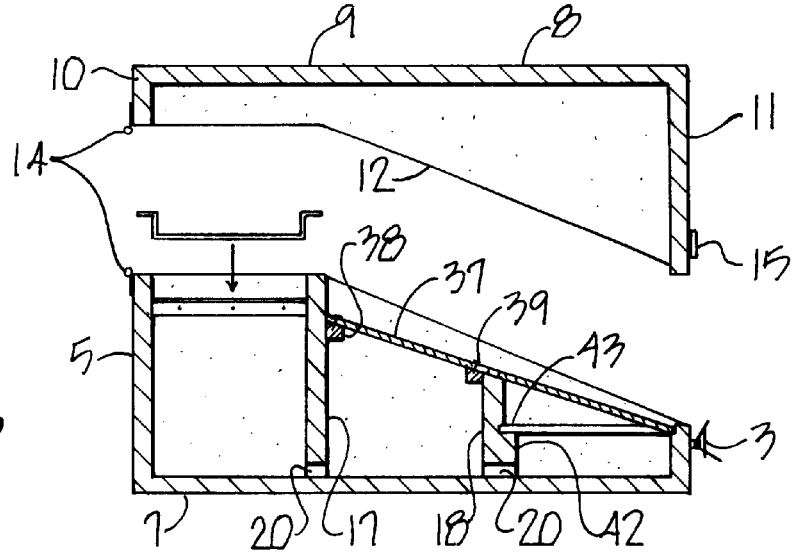
FIG. 4 is a transfer sectional view taken along lines 4—4, FIG. 2.
Figure 5:
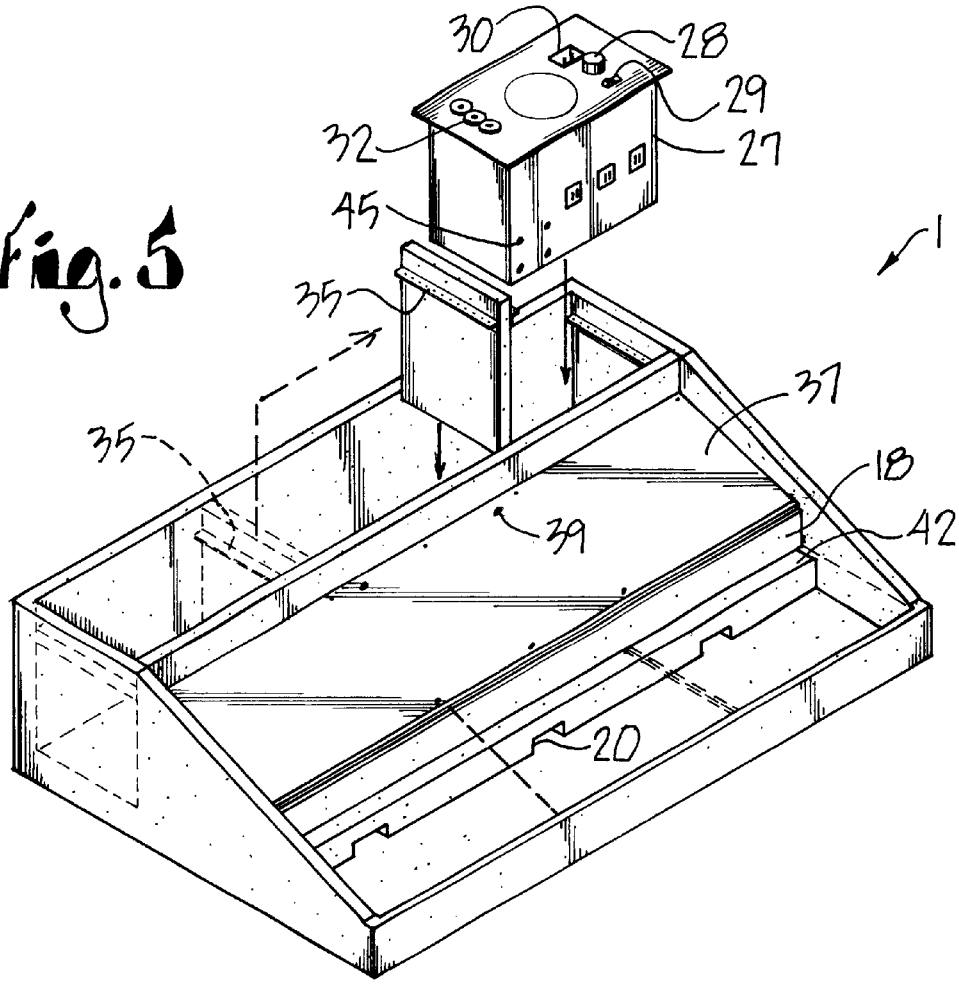
FIG. 5 is a perspective view of the pedal board illustrating features thereof.

The bottom tier 24 is variable in pitch or tilt and is formed of three individual panels 41 each separately supported by supports 42 and held therein by screws 43. The supports 42 may be used or the individual panels 41 may be secured to ledges cut in the top of the second interior wall 18, such as shown in FIGS. 4 and 5. In this manner, the tilt of the individual panels 41 can be selected to be level or can be adjusted to be at the same degree of tilt or slope as the middle panel 37. When the individual panels 41 in the bottom tier 24 are positioned level, the bottom tier and the middle tier 23 and 24 are arranged for supporting smaller sound effect generators or foot pedals of a size commensurate with the depth of the tier. An exemplary measurement of the bottom tier is 6½ inches by 28.75 inches. Larger foot pedals of a size commensurate with the combined depth of the middle tier 23 and the bottom tier 24 are accommodated by positioning the bottom tier individual panels 41 in a tilted pitch mode at the same tilt as in the middle tier 23. As shown, there are three individual panels 41 so that the pedal board assembly 1 may hold a mix of long and short rack mount devices or foot pedals. The foot pedals are connected by wires running through holes in the tier panels and then directly into the junction box 27 which are run through the wiring passages 20, and connect to jack receptacles 45 in the lower body of the box 27. Power lines may also be run through the same passages.

Thus, the pedal board assembly 1 is able to hold one or more short sound effect generators in the top tier 22 and either short or long sound effect generators in the middle tier 23 and bottom tier 24 with the long devices extending over the combined depth of both the middle tier 23 and bottom tier 24. The generators are connected by wiring into the electrical box 27 with exit cables therefrom connected to amplifiers and other electrical equipment used by musicians. The cover 8 can be engaged over the receptacle 2 with the foot pedals remaining positioned on the receptacle 2 so that the pedal board assembly 1, with the foot pedals therein, can be removed when the band dissembles its equipment for transportation.

What is claimed and desired to be protected by Letters Patent is:

1. A pedal board for receiving a plurality of foot pedal operated musical sound effect generators and comprising a box like receptacle with a removable lid and comprising therein:

a) a generally level top tier including a power supply and audio circuit interface;

b) a tilted middle tier; and c) a lower tier which can be arranged in a level mode or a tilted mode, the tilted mode matching the tilt of the middle tier so that large sound effect generators may be placed across to span both the middle tier and the lower tier.

2. The pedal board set forth in claim 1 wherein said lower tier includes spacers which variably fit under a panel forming a surface of said lower tier, the presence or absence of said spacers under said panel determining whether said panel is level or tilted.

3. A pedal board for receiving a plurality of foot pedal operated musical sound effects generators and comprising a receptacle with a plurality of tiers for receiving said sound effect generators, the tiers including at least a first tier which is able to be tilted to match the tilt of a second tier to accommodate a sound effects generator extending between said first and second tiers.

4. The pedal board set forth in claim 3 wherein there are three tiers with said first tier being the lower most tier and said second tier being the middle tier.

5. The pedal board set forth in claim 3 including a power supply and audio circuit controls.

* * * * *